US006302016B1

(12) United States Patent
Fausto et al.

(10) Patent No.: US 6,302,016 B1
(45) Date of Patent: Oct. 16, 2001

(54) MACHINE FOR THE SECURITY PRINTING OF SECURITY PAPERS

(75) Inventors: Giori Fausto, Lausanne (CH); Johannes Georg Schaede, Würzburg (DE)

(73) Assignee: De La Rue Giori S.A., Lausanne (CH)

( * ) Notice: Subject to any disclaimer, the term of this patent is extended or adjusted under 35 U.S.C. 154(b) by 0 days.

(21) Appl. No.: 09/385,811

(22) Filed: Aug. 30, 1999

(30) Foreign Application Priority Data

Sep. 8, 1998 (CH) ..... 1834/98

(51) Int. Cl.[7] ..... B41L 13/06; B41L 13/12
(52) U.S. Cl. ..... 101/118; 101/116; 101/33
(58) Field of Search ..... 156/566, 567, 156/568, 570; 101/22, 23, 33, 34, 116, 118, 119

(56) References Cited

U.S. PATENT DOCUMENTS

| | | | |
|---|---|---|---|
| 5,429,044 | 7/1995 | Giori et al. . | |
| 5,618,378 | 4/1997 | Cahill . | |
| 5,698,034 * | 12/1997 | Clark et al. | 118/669 |
| 5,820,971 | 10/1998 | Kaule et al. . | |
| 5,873,305 | 2/1999 | Dell'olmo . | |
| 6,098,546 * | 8/2000 | Schell | 101/492 |

FOREIGN PATENT DOCUMENTS

| | | |
|---|---|---|
| 44 04 128A1 | 8/1994 | (DE) . |
| 0 441 596A1 | 8/1991 | (EP) . |
| 0 625 466 A1 | 11/1994 | (EP) . |
| WO 96 14994 | 5/1996 | (WO) . |

OTHER PUBLICATIONS

International Search Report in SN 1834/98—Switzerland.

* cited by examiner

*Primary Examiner*—Daniel J. Colilla
(74) *Attorney, Agent, or Firm*—Bugnion S.A.; John Moetteli

(57) ABSTRACT

The machine comprises a paper sheet-feed device (1), a device (2) for transferring toward a printing unit, a device for transferring printed sheets toward a unit (8) for checking the print quality and a storage unit (10, 11, 12). The printing unit can be altered to suit different types of security printing and consists of elements common to all these different types of printing. These common elements are: a screen-printing device (3, 4) comprising a screen stencil cylinder (3) cooperating with a press cylinder (4) and a drying/activation device (5) located downstream, followed by a transfer cylinder (6) for transferring toward a second press cylinder (7). The latter cooperates with at least one device (13) for printing a security element.

9 Claims, 4 Drawing Sheets

MACHINE FOR THE SECURITY PRINTING OF SECURITY PAPERS

BACKGROUND OF THE INVENTION

The present invention relates to a machine for the security printing of security papers comprising a paper sheet-feed device, a device for transferring the papers toward a printing unit, a device for transferring printed sheets toward a unit for checking the print quality and a unit for storing printed sheets.

It is already known practise to incorporate, by way of security elements, optically-varying images or the like in the form of a film, for example on bank cards or security papers, particularly banknotes, so as to prevent counterfeiting thereof or make counterfeiting more difficult. These images, which are often optically varying comprising either a hologram or a kinegram, have the feature of changing appearance depending on the angle from which they are viewed.

Such images may be applied by different methods. By way of example, mention may be made of the device described in document EP-A-O 441 596 (MOLINS), the noncontradictory content of which is incorporated by reference, which describes a method and device for the cold application of such an image to a banknote. According to this device, the paper, in the form of sheets, having undergone selective application of an adhesive ink at specific points corresponding to the printings of the notes, and having traveled past the ultraviolet-radiation drying device, passes into a unit for applying such an image carried by a ribbon, which is dispensed between a dispensing reel mounted in a first cassette and a take-up reel mounted in a second cassette. The travel of the ribbon is parallel to the movement of the paper.

In document EP-A-0 625 466 (DE LA RUE GIORI), the noncontradictory content of which is incorporated by reference, the optically varying images, also supported by a ribbon, are applied to specific points, the application unit comprising at least one applicator cylinder and cooperating with an impression cylinder between which cylinders the paper passes. The ribbon is mounted between two reels arranged in one sector of the applicator cylinder and the ribbon passes along a generatrix of said applicator cylinder at right angles to the path of the paper.

This type of apparatus is equipped with means making it possible to ensure that the application of optically varying images is perfectly in register with the desired position on the security paper. These apparatuses are theoretically intended for just one single type of printing of security elements, they are expensive and are therefore not suitable for limited runs or for runs of security papers in which perfect print quality is not required.

If there is a desire to apply two security elements to a security paper using different methods, it is necessary to have use of two apparatuses, each one specific to the type and method of application of the security element. Likewise, or if there is a desire to be able to print security designs on limited editions using different methods, it is necessary to have one apparatus per method.

SUMMARY OF THE INVENTION

The object of the present invention is to provide a solution to the abovementioned problems, namely to propose a security printing machine which can easily be converted to apply one or other of the known security printing methods.

The machine according to the invention is one wherein the printing unit can be altered to suit different types of security printing and consists of the following elements common to all these different types of printing: a screen-printing device comprising a screen stencil cylinder cooperating with a press cylinder and a drying/activation device located downstream, followed by a transfer cylinder for transferring toward a second press cylinder intended to cooperate with at least one device for printing a security element.

The advantage of the machine according to the present invention is that as a result of an astute choice of certain elements which are to form a permanent part of this machine, it is easily possible to adapt the machine to different types of security printing without each time having to resort to an apparatus specific to each type of security printing. It is thus relatively easy, starting out from the basic apparatus, to add modules cooperating with this basic apparatus so as to obtain the security printing of one's choice and, in accordance with the alternative forms described below, to do so at limited investment cost.

According to one alternative form of the aforementioned basic elements of the printing machine, an apparatus is added for applying images in the form of stamps or strips, said images being supported by a ribbon traveling between a dispensing reel and a take-up reel parallel to the movement of the paper and between the second press cylinder and an applicator cylinder cooperating with the press cylinder.

Depending on the work and on the type of stamp or strip that is to be applied, the screen-printing unit may, beforehand, print an ink which is either part of an adhesive or an adhesive onto the paper passing between the press cylinder and the screen stencil cylinder. This application is performed selectively at those points on the paper intended subsequently to receive the security stamps or strips.

When part of an adhesive is applied, the second part is directly on the security stamp or strip, and the applicator cylinder is heated to allow these two parts to be activated. When an adhesive is a one-part adhesive, the security stamps or strips are applied to this adhesive directly and in the cold state by the applicator cylinder.

According to another embodiment, the security printing is performed by at least one applicator cylinder cooperating with the second press cylinder between which the paper travels, the applicator cylinder being equipped with at least one pair of reels between which the ribbon is mounted and passes along a generatrix, that is to say that the ribbon in this case travels at right angles to the forward movement of the paper intermittently between each application. In this case, each cylinder may comprise several pairs of such reels making it possible, in a single pass of the paper to print the security elements on several rows of sheets. Likewise, it is also possible to have a second applicator cylinder, as described moreover, in EP-A-0 625 466 mentioned earlier. In this apparatus, the screen printing unit is used either to apply a first part of an adhesive, the second part being on the stamps or strips, and application is performed in the hot state, or the screen-printing apparatus applies a simple adhesive and a stamp or strip with the security design is applied in the cold state.

According to another embodiment similar to the one in which the ribbon travels parallel to the movement of the paper, the stamp or strip applied in the hot state (so the screen-printing unit applies a first non-adhesive part to the paper) is partially printed or not printed at all and a microstructure is impressed after the stamp or strip has been applied to the paper. To this end, the apparatus comprises, in addition to the abovementioned elements for applying a stamp or strip from a ribbon traveling parallel to the movement of the paper, a plate cylinder equipped with a plate which has a design in relief. As the paper with the security element passes between the second press cylinder and the plate cylinder, a microstructure is impressed by embossing the stamp or the strip. After this deformation, a second screen stencil cylinder arranged downstream of the plate cylinder applies a lacquer, also selectively, to the design thus created, thus allowing the microstructure obtained by embossing the paper to be fixed. Downstream of this application of lacquer, a drying unit allows the lacquer to be dried before it passes to the unit for checking said print quality.

Finally, in another embodiment still starting out from the basic machine, the screen-printing unit is designed to apply a layer of a coating intended to be printed by embossing.

The second impression cylinder is, in this case as in the previous case, in contact with a plate cylinder bearing an impression plate which is in relief and which, when it comes into contact with the coating applied earlier in the screen-printing unit, forms an image by embossing said coating. In this apparatus too, a lacquer is applied to the microstructure thus created, by means of a screen stencil cylinder also in contact with the second press cylinder. Thereafter, a drying unit allows said lacquer to be dried and the impressed microstructure thus to be fixed. The paper then passes into the unit for checking the print quality.

BRIEF DESCRIPTION OF THE DRAWINGS

The invention will be described in greater detail with the aid of the appended drawing.

DETAILED DESCRIPTION OF THE PREFERRED EMBODIMENT(S)

Figure 1:
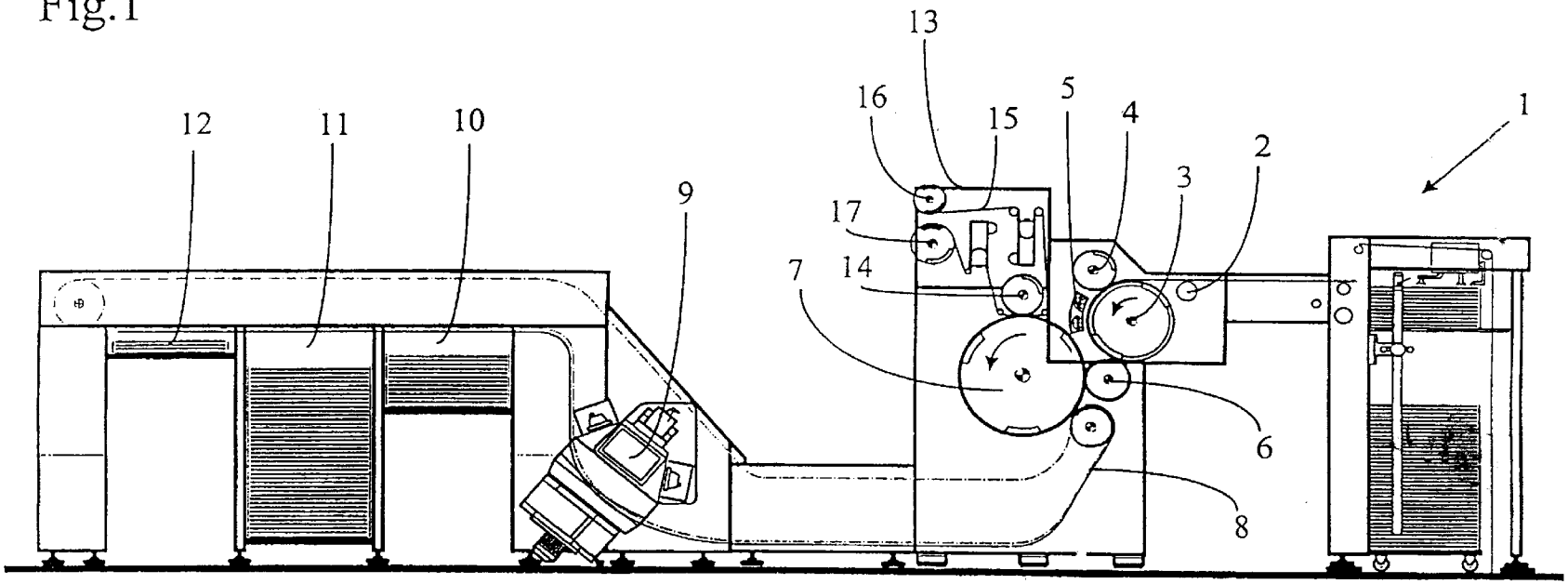
FIG. 1 is a schematic side view of an apparatus in which the security design is applied from a ribbon traveling parallel to the movement of the paper.

In the figures which follow we have used the same references to denote the elements which form the actual basis of the apparatus. We are therefore going to describe and label the common elements using the same numbers.

The apparatus comprises a sheet feed device 1 for security papers, particularly banknotes. These sheets, which may or may not be already partially printed, are conveyed one by one through a feed roll 2 to a first press cylinder 3 cooperating with a screen stencil cylinder 4. The cylinders 3 and 4 constitute the screen-printing unit. Downstream of these two cylinders is a drying/activation device 5 which is preferably a device of the ultraviolet type. Thereafter, a transfer cylinder 6 allows the sheets to be transferred to a second press cylinder 7. Thereafter, and depending on the form of embodiment, other elements allow the security design to be printed, as will be explained later. After printing, the sheets thus printed are taken up by a gripper-type transfer device 8. The sheets pass through a unit 9 for checking the print quality before being directed toward a facility 10, 11, 12 for storing printed sheets.

We shall now describe the alternative form of the apparatus which is presented in FIG. 1.

Compared with the basic apparatus, this apparatus comprises a unit 13 intended to apply stamps or strips which have a security image to the sheets of paper passing between the second press cylinder 7 and the applicator cylinder 14. The unit 13 will be described briefly and is similar to the one described in document EP-A-411 596. The security images in the form of stamps or strips are supported by a ribbon 15 stretched between two reels 16 and 17, the reel 16 being a reel which unwinds while the reel 17 winds up. The ribbon passes through various guide devices before passing between the applicator cylinder 14 and the press cylinder 7 for applying a stamp or strip at the intended location.

The device 13 of course comprises a device making it possible to check that the images that are to be applied are in register with the locations on the paper located between the cylinder 7 and the applicator cylinder 14. In theory, the ribbon advances stepwise but, depending on the application, and particularly if the application of strips is involved, use could very well be made of an apparatus in which the ribbon 15 advances at the same time as the paper.

The screen-printing unit 3, 4 is equipped, in an alternative form, to apply a first part of an adhesive in the form of an ink to predetermined points on the paper located between the press cylinder 3 and a screen stencil cylinder 4; the paper then travels past a device 5 for drying or activating said part and is thereafter taken up by the press cylinder 7. In this first alternative form, the second part of the adhesive is already on the stamps or strips and at the time of application the applicator cylinder 14 is heated to cause the stamp or the strip to adhere to the security paper.

According to another alternative form of embodiment, the screen-printing unit 3, 4 makes it possible to apply to predetermined points on the paper an adhesive which is activated by the unit 5 and when the sheet of paper passes between the press cylinder 7 and the applicator cylinder 14, bonding is obtained in the cold state.

The unit 13 may be in the form of a closed element which could be termed a cassette. It is obvious that if the paper has several columns in the direction of travel of the paper, the cassette has several parallel ribbons, thus making it possible, in a single pass, to apply the stamp or strip to all the columns on the sheets of paper.

Figure 2:
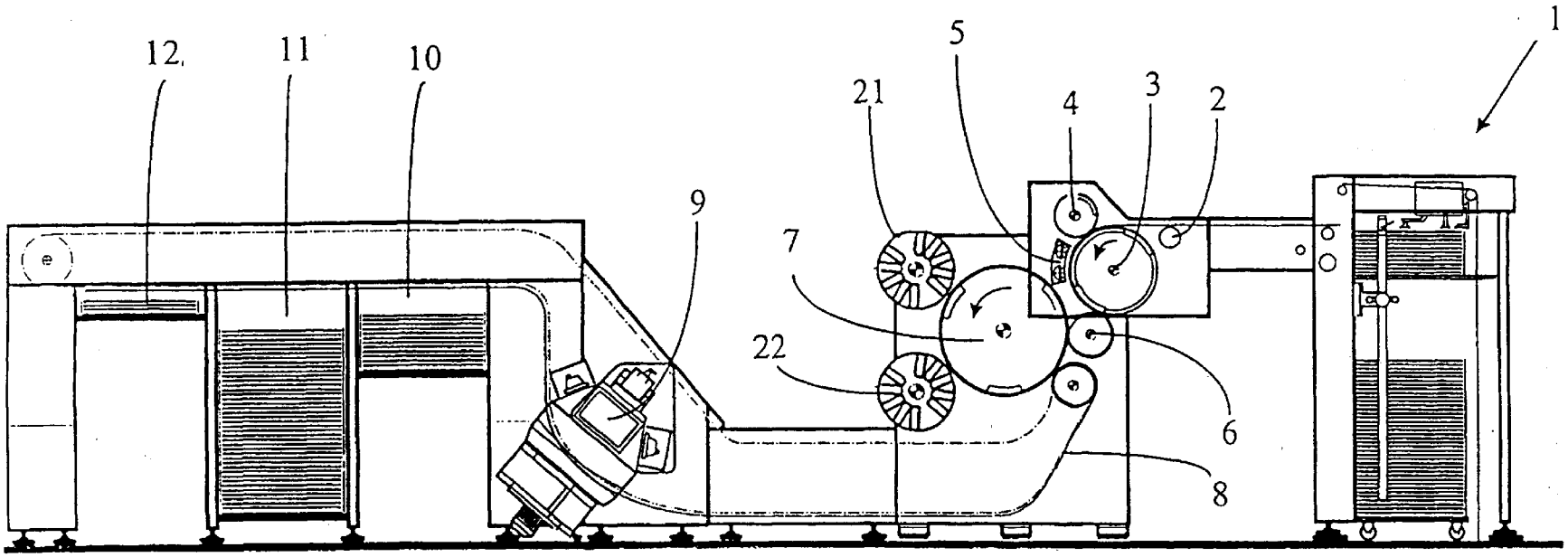
FIG. 2 also depicts a schematic side view of an apparatus, in which the security design is applied from a number of ribbons traveling at right angles to the movement of the paper.
Figure 3:
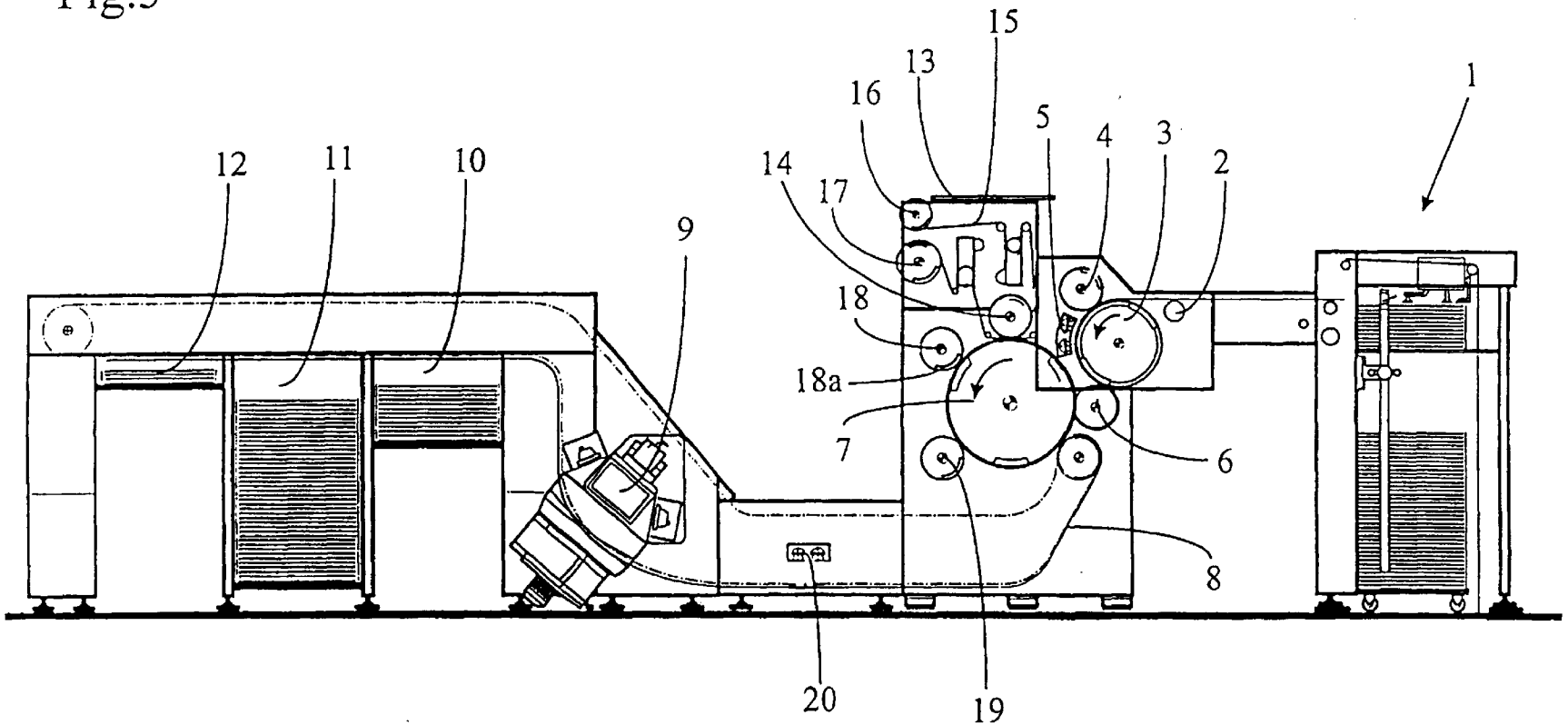
FIG. 3 is an alternative form of FIG. 1.

We shall now describe the alternative embodiment of FIG. 3, which is entirely similar to the one in FIG. 2 with one exception; the cassette 13 may contain a ribbon bearing stamps or strips which are partially printed or not printed at all and after they have been applied, either in the hot state or in the cold state as described earlier, a plate cylinder 18 in contact with a second press cylinder 7 allows a reliefed structure or matrix to be created on the stamp or on the strip by means of a plate 18*a* which has an image in relief, this occurring as the paper passes between the plate cylinder 18 and the press cylinder 7. It is obvious that, in this case, the material used to manufacture these stamps or strips has a structure which allows this printing by embossing. Thereafter, the paper thus printed passes between a screen stencil cylinder 19 and the press cylinder 7 so that a lacquer can be applied to the matrix thus formed in order to fix it. When the paper is taken up by the transfer device 8, the paper travels past a drying unit 20 which is advantageously a unit of the ultraviolet type.

The advantage of this apparatus is that it would be possible, particularly for relatively limited editions, to use a ribbon 15 carrying stamps or strips which are partially printed or not printed at all and to change the plate 18*a* to print editions of security papers with different patterns.

The apparatus depicted in FIG. 2 for applying security designs comprises two applicator cylinders 21, 22 equipped with reels fixed to the applicator cylinders. These reels allow a ribbon to be dispensed along a generatrix of the applicator cylinder 21 or 22 and thus as the sheet of paper passes between the applicator cylinder and the press cylinder 7, the stamp or strip is fixed to the sheet of paper at the intended point. Each cylinder 21, 22 may comprise several pairs of reels to allow the running of ribbons with the labels or strips equipped with a security design so that the stamps or strips can be applied to several rows of security papers printed on the sheets of paper, in a single pass. For further information and details regarding the applicator cylinders 21, 22, reference may be made to Patent Application EP-A-0 625 466.

It is obvious that in this case, the ribbon travels at right angles to the movement of the paper. Here too, the screen-printing unit is used in two different ways: either the screen stencil cylinder 4 deposits a first part of an adhesive at predetermined points on the paper and the stamps or strips on the ribbon comprise the second part which is activated upon application by the applicator cylinder 21 or 22 by heating, or the screen stencil cylinder 4 is used to deposit a layer of adhesive and the labels or strips are applied in the cold state.

Figure 4:
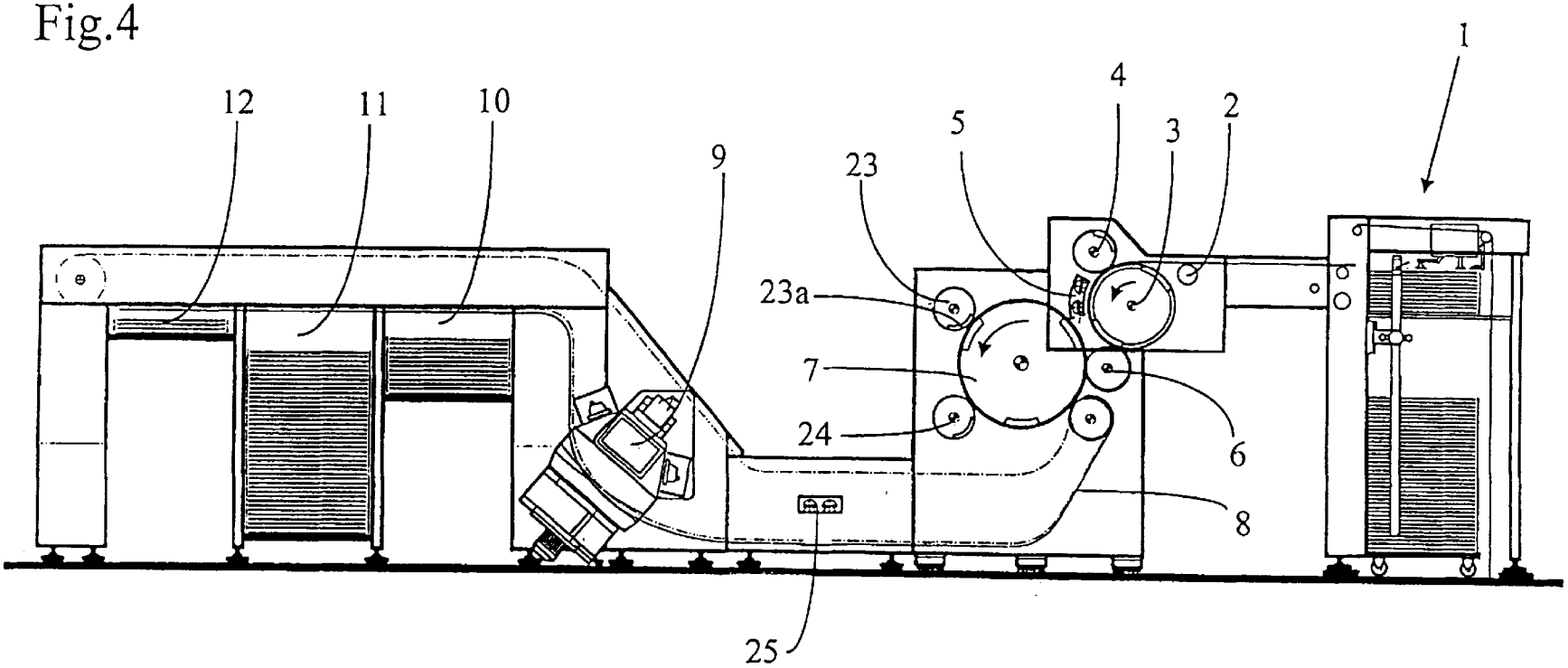
FIG. 4 depicts a schematic side view of an apparatus whereby a coating is applied to the sheets and is then printed by embossing.

Finally, in the apparatus of FIG. 4, the screen-printing unit 3, 4 applies a layer of coating to predetermined points on the sheet which passes between the press cylinder 3 and the screen stencil cylinder 4. This layer is dried by the ultraviolet drying apparatus 5. A plate cylinder 23 bears a plate 23*a* which, in relief, defines a matrix which can be printed by embossing onto the coating already applied to the sheets of paper. Thereafter, a second screen stencil cylinder 24 allows a lacquer to be applied to the matrix thus formed, in order to fix it. As before, a drying unit 25 allows the lacquer to be dried before the sheet passes on to the quality-control unit.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A machine for the security printing of security papers comprising a paper sheet-feed device (1), a device (2) for transferring the papers toward a printing unit, a device for transferring printed sheets toward a unit (9) for checking the print quality and a unit (10, 11, 12) for storing printed sheets, wherein the printing unit is alterable to suit different types of security printing and comprises the following elements common to all these different types of security printing: a screen-printing device (3, 4) comprising a screen stencil cylinder (3) cooperating with a press cylinder (4) and a drying/activation device (5) located downstream of the screen printing device (3, 4) said drying/activation device (5) followed by a transfer cylinder (6) for transferring the sheets toward a second press cylinder (7) and at least one device for printing a security element, said at least one device for printing a security element cooperating with said second press cylinder.

2. A machine as claimed in claim 1, wherein the device (13) for printing a security element is designed to apply the security elements in the form of stamps or strips which are supported by a ribbon (15), said ribbon (15) traveling between a dispensing reel (16) and a take-up reel (17) parallel to the movement of the paper, said security element being applied to the paper as the paper and said ribbon pass between an applicator cylinder (14) and the second press cylinder (7).

3. A machine as claimed in claim 2, wherein the screen-printing unit (3, 4) applies a first part of an adhesive to the paper, the security stamps or strips carrying a second part of an adhesive and the applicator cylinder (14) being heated.

4. A machine as claimed in claim 3, which comprises a plate cylinder (18) in contact with the second press cylinder (7), the plate cylinder (18) is equipped with a plate (18*a*) with a matrix in relief for printing a security element by embossing, and a second screen stencil cylinder (19) is in contact with the second press cylinder (7) to apply a lacquer to the image thus created by embossing, and a drying device (20) is arranged downstream of the second screen stencil cylinder (19).

5. A machine as claimed in claim 2, wherein the screen-printing unit (3, 4) applies an adhesive to the paper.

6. A machine as claimed in claim 1, wherein the device for printing a security element comprises at least one applicator cylinder (21, 22) cooperating with the second press cylinder (7) between which cylinders the paper travels, said applicator cylinder (21, 22) being equipped with at least one pair of reels between which the ribbon is mounted and passes along a generatrix of the applicator cylinder (21, 22) at right angles to the path of the paper, the ribbon moving intermittently upon each application.

7. A machine as claimed in claim 6, wherein the screen-printing unit (3, 4) applies a first part of an adhesive to the paper, the security elements carrying the second part and the applicator cylinder (21, 22) being heated.

8. A machine as claimed in claim 6, wherein the screen-printing unit (3, 4) applies an adhesive to the paper.

9. A machine as claimed in claim 1, wherein the screen-printing unit (3, 4) is equipped to apply a layer of a coating that will be printed by embossing, a plate cylinder (23) is equipped witb a plate (23*a*) with a matrix in relief is in contact with the second press cylinder (7) to form an image with a security matrix on said coating by embossing, and a second screen stencil cylinder (24) is in contact with the second press cylinder (7) to apply a lacquer to the image formed by embossing and a device (25) for drying said lacquer is arranged downstream of the second screen stencil cylinder (24).

* * * * *